United States Patent [19]

Jagger

[11] 4,380,122

[45] Apr. 19, 1983

[54] CUTLERY IMPROVEMENTS FOR AIDING EFFECTIVE AND CORRECT USE THEREOF

[75] Inventor: Peter C. Jagger, Cuckfield, England

[73] Assignee: Little People Limited, Hong Kong, Hong Kong

[21] Appl. No.: 187,722

[22] Filed: Sep. 16, 1980

[30] Foreign Application Priority Data

Sep. 17, 1979 [GB] United Kingdom ..... 32098/79

[51] Int. Cl.[3] ..... B25G 3/00

[52] U.S. Cl. ..... 30/343; 30/295

[58] Field of Search ..... 30/295, 343

[56] References Cited

U.S. PATENT DOCUMENTS

| | | | |
|---|---|---|---|
| D. 85,503 | 11/1931 | Xardell | 30/295 |
| 108,141 | 10/1870 | Houseman et al. | 30/295 |
| 140,997 | 7/1873 | Eddy | 30/343 |
| 269,276 | 12/1882 | Frary | 30/343 |
| 356,453 | 1/1887 | Cox | 30/295 |
| 479,102 | 7/1892 | Willbrandt | 30/343 |
| 649,059 | 5/1900 | Kern | 30/295 |
| 983,736 | 2/1911 | Maconochie | 30/295 |
| 1,444,659 | 2/1923 | Carlson | 30/295 |
| 1,754,543 | 4/1930 | Callum | 30/295 |
| 2,115,686 | 4/1938 | Zimmer | 30/295 |
| 2,168,237 | 8/1939 | Polacsek | 30/295 |
| 2,352,013 | 6/1944 | Roth . | |

FOREIGN PATENT DOCUMENTS

| | | | |
|---|---|---|---|
| 495489 | 8/1953 | Canada . | |
| 704635 | 4/1941 | Fed. Rep. of Germany | 30/295 |
| 729897 | 5/1932 | France | 30/295 |
| 9733 | 5/1964 | New Zealand . | |
| 9746 | 8/1964 | New Zealand . | |
| 393980 | 11/1965 | Switzerland | 30/343 |

*Primary Examiner*—James G. Smith
*Assistant Examiner*—J. T. Zatarga
*Attorney, Agent, or Firm*—Wood, Herron & Evans

[57] ABSTRACT

A piece of cutlery which is designed to assist people such as children who are unfamiliar with cutlery, how to use it effectively and correctly. The piece of cutlery has a recess in the upper surface of the handle in the region where the handle and operative portion, e.g. the knife blade or fork prongs, of the piece of cutlery join. This recess is centered on the longitudinal center line of the piece of cutlery and is of a size to accommodate and locate the tip of the user's index finger in the effective and correct position for the user of the piece of cutlery. Also it is of sufficient depth to prevent accidental displacement of the tip of the finger during normal usage of the piece of cutlery. Preferably, the handle is S-shaped when viewed from the left-hand side so that it fits snugly in the palm of a child's hand with the tip of the index finger positioned in the recess.

17 Claims, 3 Drawing Figures

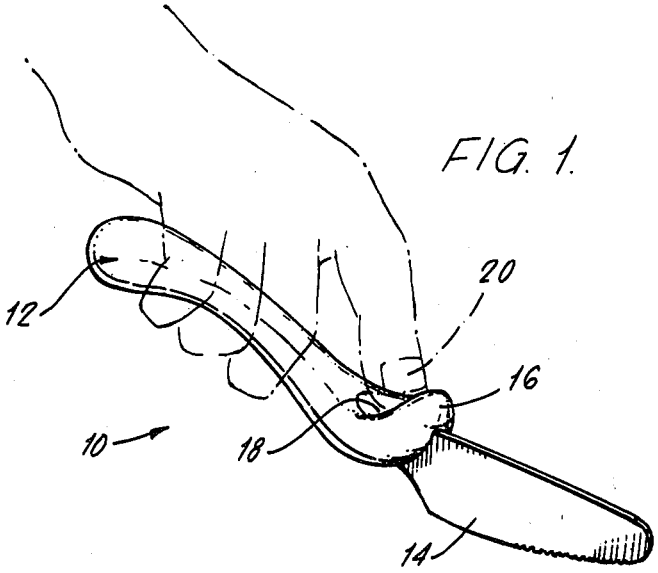
FIG. 1.
FIG 2.
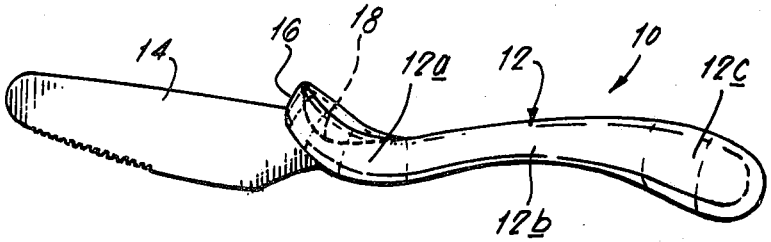
FIG. 3.
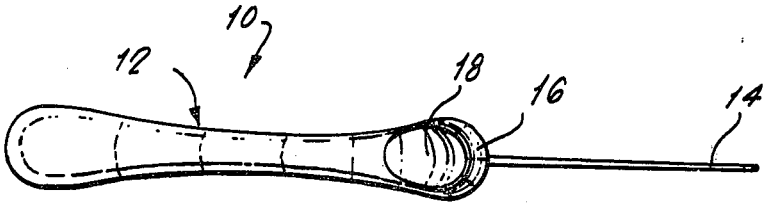

CUTLERY IMPROVEMENTS FOR AIDING EFFECTIVE AND CORRECT USE THEREOF

This invention relates to cutlery and in particular cutlery for use by children or more generally people who are not used to using western-style cutlery.

BACKGROUND TO THE INVENTION

A young child often finds it difficult to hold a knife or fork correctly. Furthermore, even if a young child is able to hold a knife or fork correctly, he seldom has sufficient muscle control to maintain the correct hold while applying pressure on the implement. The same may be true for an adult who is not used to western-style cutlery, e.g. someone who normally uses chopsticks. As a result such people find it difficult to use a knife and fork correctly and effectively. Existing children's cutlery is simply a scaled down version of full size cutlery; therefore it is an object of the invention to provide cutlery which is designed to enable the user to hold and use it correctly.

BRIEF SUMMARY OF THE INVENTION

According to the invention there is provided a piece of cutlery comprising a handle, an operative portion such as a knife blade or fork prongs, and in the region where the handle and operative portion join, a recess in the upper surface of the handle centred on the longitudinal centre line, as viewed from above, of the piece of cutlery, that recess being of a size to accommodate and locate the tip of the index finger of the user's hand, and being of sufficient depth below at least the front and sides of the rim of the recess to prevent accidental displacement of the tip of the finger during normal usage of the piece of cutlery.

When such a piece of cutlery is used the child or other person can readily perceive the correct way to hold the piece of cutlery and he places his index finger in the recess. The walls around the recess prevent the index finger from slipping out of the recess when pressure is applied by the user through his index finger. The user is thus able to use the piece of cutlery so as to be able to exert good cutting or piercing pressure on the operative portion with the index finger and as a further advantage his resulting use will accord with generally accepted standards of politeness in the use of cutlery.

The shape and positioning of the recess in relation to the rest of the piece of cutlery are such that the user is in effect forced to use the recess for the tip of the index finger if this is placed on the top of the piece of cutlery since there is nowhere else where the tip of the finger can rest comfortably.

The recess may be formed by a simple indentation in the top surface of the handle and/or operative portion provided that indentation is deep enough to locate the index finger but preferably it is formed at least in part by providing a wall upstanding from the general line of the handle, the wall defining at least in part the recess within itself. The wall can extend completely or substantially completely around the recess or more preferably extends around the front and sides of the recess, e.g. the wall is of horse-shoe shape, leaving the rear of the recess open so that the index finger be positioned comfortably along the top of the handle with the end entering the recess. Preferably, the wall is higher at the front than at the back of the recess and tapers or slope down in height from the front of the recess along the sides thereof.

The maximum depth of the recess from the highest part of the rim to the lowest part of the recess is chosen according to the use of the piece of cutlery. Thus, for use by a child, the recess need not be as deep, e.g. 4 to 10 mm, as when the piece of cutlery is intended for use by an adult, e.g. 5 to 12 mm. In general, therefore, this maximum depth ranges from 2 to 12 mm and preferably is from 6 to 9 mm, so that it is at least about one half the thickness of the index finger and is preferably as deep as the index finger is thick. In this way, the recess provides effective location of the finger tip so that it will not become displaced during normal usage.

The recess will normally be of generally oval shape when viewed from above so as to accommodate the tip of a child's index finger comfortably, the major axis of the oval being aligned with the longitudinal axis of the piece of cutlery as seen from above. The dimensions of this oval-shaped recess will be chosen to suit the size of the intended user's finger tip. Thus, for a child's usage the length along the major axis could range from 6 to 12 mm and the length along the minor axis from 5 to 10 mm, whilst for adult usage the length along the major axis could range from 10 to 20 mm and along the minor axis from 10 to 18 mm.

Often the recess may be wider, as seen from above, than for the adjacent portion of the handle. In such cases the handle preferably has an enlarged or bulbous portion adjacent the joint between the handle and operative portion, the recess being provided in that enlarged portion.

In order to exert good cutting pressure on, for example, a knife blade, the tip of the index finger is desirably placed on about the longitudinal centre line, as viewed from above, of the knife or other item of cutlery, in a position on or close to the joint between the handle and the knife blade or other operative portion. Accordingly, in a knife or other piece of cutlery according to the invention the centre of the recess is positioned on the longitudinal axis as viewed from above of the piece of cutlery and is preferably positioned over the joint between the handle and the operative portion. If the centre of the recess is not directly over this joint, it is preferably displaced therefrom by an amount no greater than about one tenth of the length of the handle.

The invention can be applied to all types of cutlery but is particularly applicable to knives and forks since with those items, it is important to be able to apply good pressure on the knife blade or fork prongs. In addition, the cutlery of the invention can be made in ways similar to conventional cutlery from materials such as metals, e.g. stainless steel or stain and corrosion resistant alloy, plastics materials or combinations thereof.

It is additionally desirable that the handle of a piece of cutlery according to the invention be shaped so that it can be held comfortably by the child. In addition, it is desirable that the shape of the handle be such that the user is encouraged to place the index finger tip in the recess. The handle preferably has a transverse cross-section which is smoothly rounded and without sharp or abrupt corners and a longitudinal cross-section which is of an elongated S-shape when viewed from the left-hand side, so as to fit snugly in the palm of a child's hand, the rear portion of the S-shaped being arranged to fit in the palm of the hand and the recess being provided at the end of the front portion of the S-shape, and the S-shape being such that with the rear portion in the palm of the hand the tip of the index finger then comfortably engages in the recess. In general the angle between the front and intermediate portions of the S-shape may range from about 100° to 140° and the angle between the intermediate and rear portions of the S-shape may range from about 150° to 160°.

BRIEF DESCRIPTION OF THE DRAWINGS

An example of a child's knife according to the invention will now be described with reference to the accompanying drawings, in which:

FIG. 1 is a perspective view of the knife;

FIG. 2 is a side view of the knife; and

FIG. 3 is a plan view of the knife.

DESCRIPTION OF THE PREFERRED EMBODIMENT

The knife 10 shown in the drawing includes a handle 12 and a knife blade 14. On the top surface of the blade near the joint between the handle and blade is an upstanding horse-shoe shaped wall 16 which at least in part defines a recess 18. The recess is substantially oval in shape as viewed from above and the major axis of the oval is approximately coincident with the longitudinal centre line of the handle as viewed from above. The dimensions of the recess in this example were a maximum length of approximately 15 mm and a maximum width of approximately 13 mm. The width of the recess is greater than the width of the front portion of the handle 12 and so as viewed from above, that front end of the handle is of an enlarged or bulbous shape.

The wall 16 is relatively high at the front and tapers down along the side walls to zero height at the rear of the side walls. The recess is therefore relatively deep at the front, in this example, the maximum depth of the recess from the highest part of the wall is about 9 mm or, in other words, about three quarters of the thickness of an adult index finger and thicker than a child's finger. Therefore, as shown in broken lines in the drawing, the recess 18 is designed to accommodate the tip of a child's index finger 20. This both provides a guide for holding the knife 10 for the most effective and polite usage and prevents accidental displacement of the tip of the finger during normal usage.

The handle 12 has a longitudinal shape which is rather like an elongate S when viewed from the left-hand side. It includes a front portion 12*a* adjacent the blade 14 which is curved downwardly relative the blade, an intermediate portion 12*b* which is curved upwardly slightly relative the blade and a rear portion 12*c* which is again curved downwardly relative the blade. These portions, 12*a*, 12*b* and 12*c* merge into one another by smooth curves. This shape comfortably fits the palm of a child's hand whilst the tip of his index finger 20 is in the recess 18, the thumb extends along the side of the handle and the other fingers grip around the handle.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

I claim:

1. A piece of cutlery having a longitudinal center line, said cutlery piece comprising a handle having an upper surface and a front end, an operative portion joined to said handle's front end, a recess positioned adjacent the joint between said operative portion and said handle's front end, said recess being provided in said handle's upper surface and being centered on said longitudinal center line, and said recess being of a size to accommodate and locate the tip of the index finger of a user's hand when the user's hand grips said handle; and a rim defining the peripheral edge of said recess, said rim having a front wall adjacent said operative portion and opposed side walls extending from said front wall toward said handle's rear end, the depth of said recess defined by said front and opposed side walls of said rim being sufficient to prevent accidental longitudinal displacement of the tip of the index finger of a user's hand out of said recess toward said operative portion, and being sufficient to prevent accidental lateral displacement of the index finger of a user's hand out of said recess in a sideways fashion, when the user's hand is holding said handle during normal usage of said piece of cutlery.

2. A piece of cutlery according to claim 1, said rim's walls being higher at the front of said recess and tapering down in a rearward direction toward the rear of said recess.

3. A piece of cutlery according to claim 1, the maximum overall depth of said recess below said rim being between 2 mm and 12 mm.

4. A piece of cutlery according to claim 1, said cutlery piece further comprising an enlarged bulbous portion, as viewed from above, at said handle's front end, said recess and said rim being defined in said enlarged bulbous portion.

5. A piece of cutlery according to claim 1, said handle having a longitudinal cross-section which is of an enlarged S-shape along both upper and lower surfaces when viewed from the left-hand side.

6. A piece of cutlery having a longitudinal center line, said cutlery piece comprising a handle having an upper surface and a front end portion, an operative portion joined to said handle's front end, a horse-shoe shaped wall comprising a front and side sections upstanding from said upper surface of said handle's front end portion, said front section being positioned adjacent said operative portion, and said front section being higher than said side sections which taper in height from a maximum at those ends adjacent to said front section to a minimum at those ends remote from said front section, and a depression in said handle's upper surface within said wall as defined by said wall, said wall and said depression together defining a recess in said handle's upper surface, said recess being centered on said longitudinal center line, said recess being of a size to accommodate and locate the tip of the index finger of a user's hand when said user holds said handle, and said recess having an overall depth of from 0.2 mm to 12 mm as defined by said wall to prevent accidental longitudinal displacement of the tip of the index finger of a user's hand out of said recess toward said operative portion, and being sufficient to prevent accidental lateral displacement of the index finger of a user's hand out of said recess in a sideways fashion, when the user's hand is holding said handle during normal usage of said piece of cutlery.

7. A piece of cutlery according to claim 6, said recess having an overall depth from 6 mm to 9 mm as defined by said wall.

8. A piece of cutlery according to claim 6, said recess being substantially oval shaped as seen from above, and said recess having a major axis of a length between 6 mm and 20 mm and a minor axis of a length between 5 mm and 18 mm.

9. A piece of cutlery according to claim 6, said cutlery piece further comprising an enlarged bulbous portion, as viewed from above, at said handle's front end portion, said recess and said wall being defined in said enlarged bulbous portion.

10. A piece of cutlery according to claim 6, said handle having a longitudinal cross-section which is of an enlarged S-shape along both upper and lower surfaces when viewed from the left-hand side.

11. A piece of cutlery having a longitudinal center line, said cutlery piece comprising a handle having an upper surface and a front end, an operative portion joined to said handle's front end, a substantially oval-shaped recess positioned adjacent the joint between said operative portion and said handle's front end, said recess being provided in said handle's upper surface, said recess having a major axis substantially centered on said longitudinal center line, and said recess being of a size to accommodate and locate the tip of the index finger of a user's and when the user holds said handle, and a rim defining the peripheral edge of said recess, said rim having a front wall adjacent said operative portion and opposed side walls extending from said front wall toward said handle's rear end, the depth of said recess defined by said front and opposed side walls of said rim being between 2 mm and 12 mm to prevent accidental longitudinal displacement of the tip of the index finger of a user's hand out of said recess toward said operative portion, and being sufficient to prevent accidental lateral displacement of the index finger of a user's hand out of said recess in a sideways fashion, when the user's hand is holding said handle during normal usage of said piece of cutlery.

12. A piece of cutlery according to claim 11, the depth of said recess below said rim being between 6 mm and 9 mm.

13. A piece of cutlery according to claim 11, said recess having a major axis of a length between 6 mm and 20 mm and a minor axis of a length between 5 mm and 18 mm.

14. A piece of cutlery according to claim 11, said rim having at least one wall upstanding from said handle's upper surface for defining said recess at least in part on said handle's upper surface.

15. A piece of cutlery according to claim 14, said rim's walls being higher at the front of said recess and tapering down in a rearward direction toward the rear of said recess.

16. A piece of cutlery according to claim 11, said cutlery piece further comprising an enlarged bulbous portion, as viewed from above, at said handle's front end, said recess and said rim being defined in said enlarged bulbous portion.

17. A piece of cutlery according to claim 11, said handle having a longitudinal cross-section which is of an enlarged S-shape along both upper and lower surfaces when viewed from the left-hand side.

* * * * *